United States Patent [19]

Moskowitz

[11] 4,093,238

[45] June 6, 1978

[54] HORSE RACING GAME

[76] Inventor: Myron Alan Moskowitz, K 21 Avon Dr., E. Windsor Township, Mercer County, N.J. 08520

[21] Appl. No.: 684,195

[22] Filed: May 7, 1976

[51] Int. Cl.[2] ..... A63F 3/00

[52] U.S. Cl. ..... 273/277; 273/240; 273/298

[58] Field of Search ..... 273/134, 152.31, 86, 273/135 R

[56] References Cited

U.S. PATENT DOCUMENTS

| | | | |
|---|---|---|---|
| 1,540,324 | 6/1925 | Fuller | 273/152.31 |
| 1,622,638 | 3/1927 | Frost | 273/152.31 |

*Primary Examiner*—Anton O. Oechsle
*Attorney, Agent, or Firm*—Robert J. Eichelburg

[57] ABSTRACT

A game comprising selection tiles having two faces, one face of such tile having one of a plurality of variables indicated thereon. Movement tiles are also provided, each movement tile having two faces, each face of the movement tile having one of a plurality of the aforementioned variables marked thereon in a manner so that no single movement tile has the same variable marked on both faces. Numbers are marked on the movement tiles the same number being used on both faces of a movement tile. The game also consists of a game board having a plurality of ranks and files, one set of ranks corresponding to each of the variables, ranks also being provided for each player. Files are arranged under each identification of variations and each identification for a designated player. The game is played by competing players randomly selecting selection tiles in which the variables face downward, each player taking a selection tile for each variable in the game. A plurality of movement tiles are selected by each player in turn and one or a plurality of movement tiles is played by placing them down with one face up. The number on the upward face is scored in the variable column corresponding to the variable on the tile so played. This process is repeated until all tiles are played and the numbers in the files under each variable rank are summed up. The sums are then given to the players having the variables obtained from the selection tiles and the player with the highest total wins.

10 Claims, 8 Drawing Figures

HORSE RACING GAME

SUMMARY OF THE INVENTION

The present invention relates to a game comprising a plurality of selection tiles, each selection tile having two faces, one of a plurality of variables appearing on only one face of the selection tile, a selection tile being provided for each of the variables. The game may also be played with sub-classes of variables and in this instance, the face of the selection tile not having a sub-class of a variable appearing thereon is marked by indicia such as a color or a pattern of some type for differentiating one class of selection tiles from another. Where subclasses of variables are employed, each variable includes a plurality of sub-classes of said variable. Where the game comprises a horse racing game, the variables are selected from at least two members of the group consisting of the names of horses, colors of horses, types of horses and names of jockeys. Where sub-classes of variables are employed in the horse-racing game, the subclasses of variables comprise a fixed number of horse names, a fixed number of horse colors, a fixed number of types of horses and a fixed number of jockey names. In one embodiment, four names of horses, four colors of horses, four types of horses and four names of jockeys are employed as the subclasses of variables. In yet another embodiment, all four variables are employed in the horse racing game, and further each one of the sub-classes of the variables, especially the aforementioned sub-classes of variables, may be employed.

The game also includes a plurality of movement tiles having two faces, each of said faces of the movement tile having one of the variables thereon in an arrangement so that the same variable does not appear on both faces of any one movement tile. Each movement tile has a number on both of the faces, the number being the same for both of the faces. Any one of a plurality of numbers may be applied to the faces of the movement tile. The sum of the numbers for each group of variables or each group of sub-classes of variables is the same. A playing board is also provided comprising a plurality of ranks and files, the ranks being provided for and corresponding to each variable and optionally for each player competing in the game. The files correspond to the ranks for the variables and are used to score the game by recording the number appearing on the face of the movement tile when the movement tile is played by a person competing in the game. Files are optionally provided corresponding to the ranks for the players in the game and are used to place a tile played by a person competing in the game. The game is played by placing the selection tiles face down and where sub-classes of variables are marked on the selection tiles and said selection tiles have indicia on the opposite face thereof, the indicia on said selection tiles is placed face up. Each of a plurality of players chooses one selection tile for each variable or sub-classes of variables to fix the variables or sub-classes of variables that each player is competing with. Each player selects a fixed number of movement tiles in turn and plays a fixed number of movement tiles in turn by placing a tile face up in the file under the rank corresponding to the player. This is repeated until all the movement tiles are played. The game is scored by taking the number of the movement tile so played and recording it in the file under the rank corresponding to the variable of the movement tile played. The numbers recorded in each file corresponding to a variable are summed up and each sum is given to the player selecting such variable through the selection of tiles so that the player with the greatest sum wins the game.

In one embodiment, each of the movement tiles has a number from 1 to 4 on both sides.

DETAILED DESCRIPTION

Game board devices involving the selection and play of game pieces and in some instances the simulation of horse racing are disclosed in the prior art U.S. Pat. Nos. 3,414,264 Schriber; 2,546,347 Rengel; 1,660,505 Hacker; 1,628,073 Sousa; and, 1,622,638 Frost.

None of the aforementioned game devices allow for the random selection of variables by competing players or the play of such variables in a manner that would allow competing players to determine approximately what variables are selected by players they are in competition with. Furthermore, these games also do not provide a method of play in which a competing player may also be playing a variable in the game to the advantage of one of the players they may be in competition with.

Additionally, the prior art games noted above are played by means of a random play of variables and do not involved any skill in the advancement of moves by competing players.

It is therefore an object of the present invention to overcome these and other difficulties encountered in the prior art.

It is a further object of the present invention to provide a game having a plurality of selection tiles for the selection of variables and a plurality of movement tiles for the advancement of game play, the advancement of tiles and game play being conducted in a manner to indicate to each player approximately the variables selected by competing players.

It is also an object of the present invention to provide a novel game based on the random selection of selection tiles and the random selection of movement tiles, both of which have variables orsub-classes of variables indicated thereon, the movement tiles having numerical values which may be played in order to accumulate numerical scores.

It is a further object of the present invention to provide a novel horse racing game based on the aforementioned objectives and which also comprises a game board and uses as the variables and sub-classes of variables the names of horses, the colors of horses, the types of horses, i.e., gelding, colt, mare or filly and the names of jockeys.

These and other difficulties have been overcome and these and other objects have been attained according to the present invention as will become apparent by reference to the disclosure and claims that follow as well as appended drawing.

Figure 1:
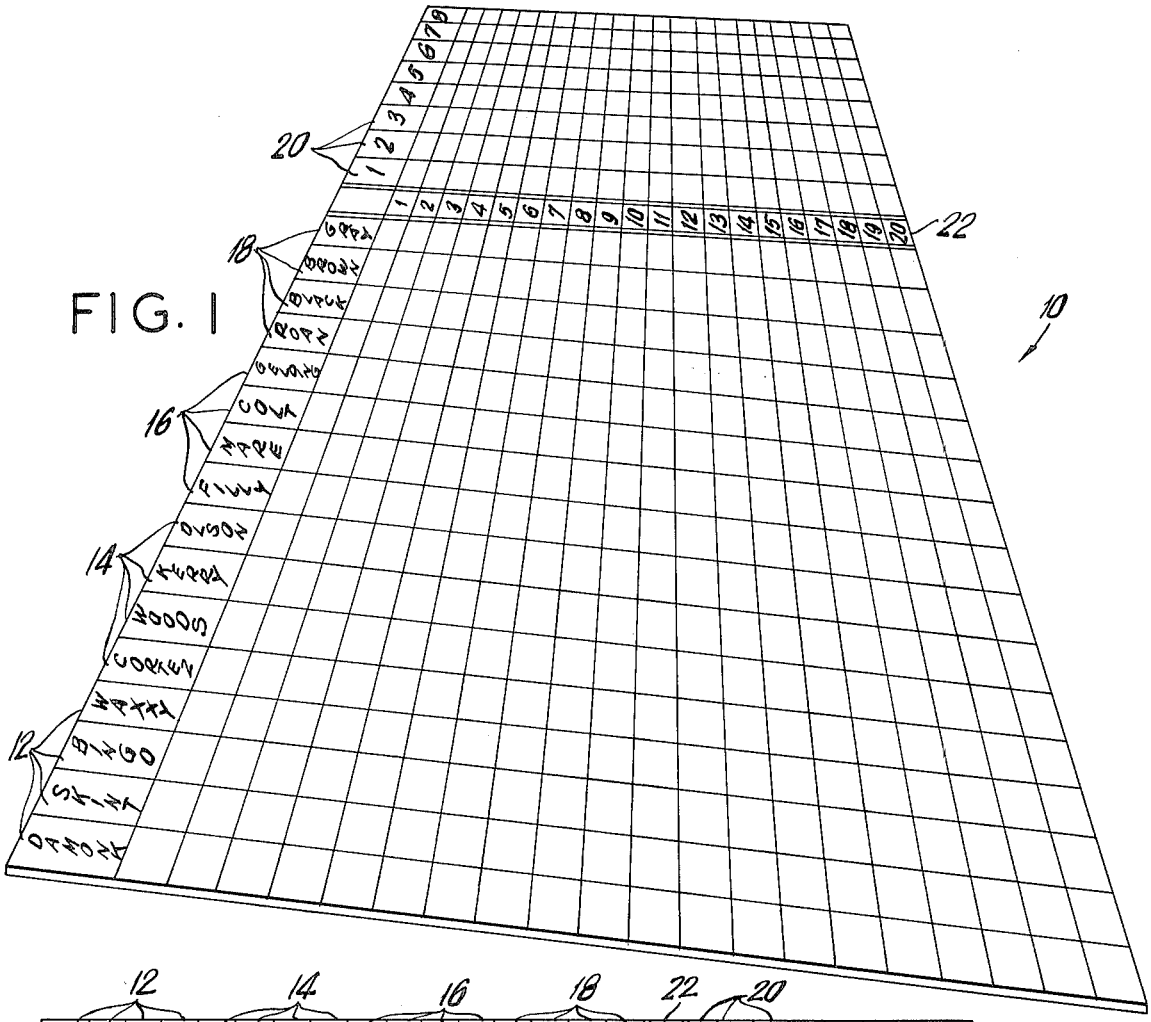
FIG. 1 comprises a perspective view of a game board having a plurality of ranks and files, the ranks being provided for and correspond to variables and each player competing in the game. The files corresponding to the ranks for the variables are used to score the game and the files corresponding to the ranks for players are used to place a movement tile played by a person competing in the game according to one embodiment of the present invention.
Figure 2:
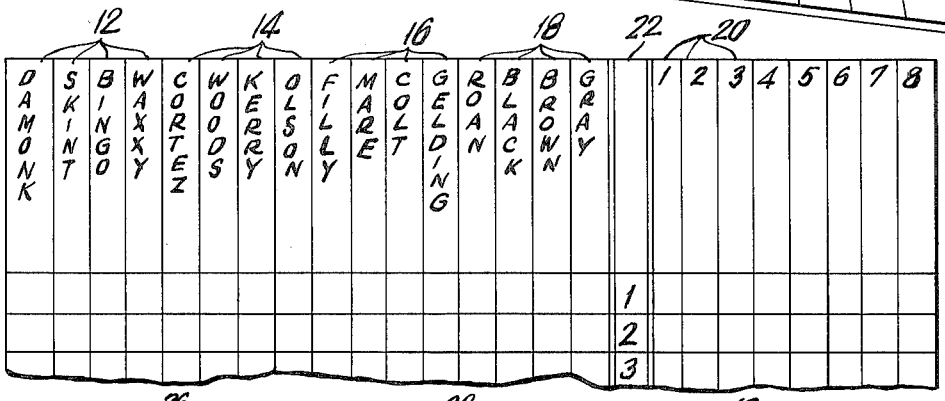
FIG. 2 comprises a plan view in section of a game board comprising a plurality of ranks and a plurality of files substantially as described with regard to FIG. 1, the number of files being selected to assure that all movement tiles are played and may comprise 30 files according to one embodiment of the present invention.
Figure 3:
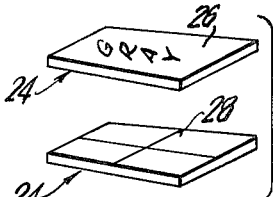
FIGS. 3–6 each comprise a perspective view of one side of a selection tile indicating a sub-class of a variable, the opposite side of said tile being marked with indicia for the general identification of such variable according to one embodiment of the invention.

Referring to the drawing, and FIGS. 1 through 8, a game board 10 is illustrated comprising a plurality of ranks 12, 14, 16 and 18 corresponding to variables and sub-classes of variables. Ranks 20 correspond to spaces for the insertion of, or correspond to, the name of each player competing in the game. The files 1 through 20 in FIG. 1 first correspond to the ranks for each variable and/or sub-class of variables (i.e., are positioned beneath ranks 12–18) and are used to score the game. The files also correspond to the ranks 20 (i.e., are positioned beneath ranks 20) for players and are used to place a movement tile played by a person competing in the game. Referring to FIG. 2, any number of ranks may be employed so long as there are a sufficient number of ranks available for allowing the play of all movement tiles. The number of movement tiles and the number values ascribed to each movement tile will depend on the length of the game desired to be played by the players. File 22 may be used to indicate either the number of turns taken by each player or the total points obtained for each variable or sub-class of variable by the play of the movement tile.

A plurality of selection tiles are employed, examples of selection tiles being illustrated in FIGS. 3–6. Each of the selection tiles illustrated in FIGS. 3–6 illustrates a sub-class of a variable by which it is meant any group of things that have one thing in common. By way of example, the sub-classes of variables employed in the horse racing game embodied in one aspect of the present invention comprise a specific color of a horse whereas the variable would be the general designation of a horse color. Thus, where a horse color is a variable, a sub-class of the variable would be one of the colors such as gray marked on face 26 of the selection tile 24 of FIG. 3, the other sub-classes of variables employed in one aspect of the invention comprising the colors brown, black and roan. Where sub-classes of variables are employed, the selection tiles 24, 30, 38 and 44 have differing indicia marked on the sides 28, 34, 42 and 48 (i.e., the face of the selection tile not having the variable or the sub-class of variable appearing thereon) for differentiating one class of selection tiles from another.

The sub-class of variable employed on tile 30 comprises the name of a horse indicated on face 32, the variable in this instance generally being the name of the horse and the sub-classes of the variables employed in one aspect of the invention comprising the names Damonk, Skint, Bingo and Waxxy.

Figure 5:
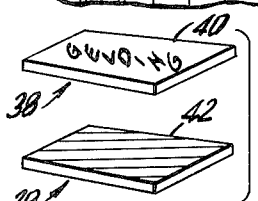

Referring to FIG. 5, tile 38 illustrates the sub-class of the variable comprising a horse type which is noted as a gelding on face 40 of the tile, the other sub-classes of horse type comprising colt, mare and filly, also being sub-classes of the general category of variable designated as horse type.

Figure 6:
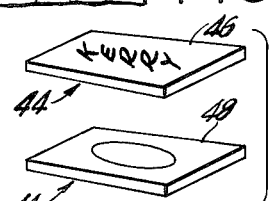

Similarly, the variable of tile 44 illustrated in FIG. 6 comprises the name of a jockey and the sub-class of variables comprise the specific names of jockeys such as Kerry, Olson, Woods and Cortez.

Figure 7:
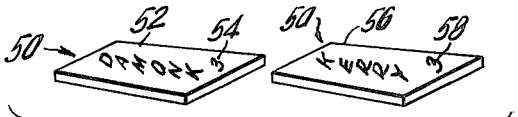
FIGS. 7 and 8 each comprise perspective views of both sides of a movement tile.
Figure 8:
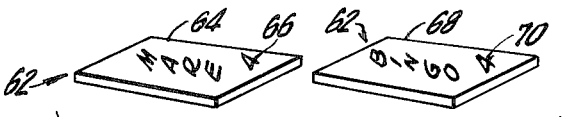

The movement tiles are illustrated in FIGS. 7 and 8 and are marked on both sides with a variable, the same variable not appearing on both faces of any one movement tile. Additionally, subclasses of variables where these are employed, and as these are specifically employed in the horse racing game of one embodiment of the present invention, are noted on sides 52 and 56 of tile 50 and sides 64 and 68 of tile 62. Any of a plurality of numbers are placed on the movement tiles, the same number being employed on both sides of the movement tile such as the number 3 being placed on the lower right hand side 54 on face 52 and the same number 3 being placed on the lower right hand side 58 on face 56 both of tile 50. Similarly, the number 4 is placed on the lower right hand sides 66 and 70 of faces 64 and 68 of tile 62.

Figure 4:
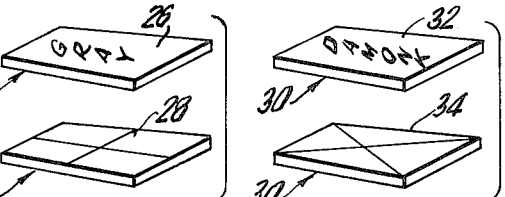

The game is played by providing selection tiles with variables thereon or as the case may be sub-classes of variables as defined and disclosed herein so that each player will choose a selection tile, the number of choices depending upon the number of variables or subclasses of variables employed in the game. The selection tiles are placed face down with the variable or sub-class of variable being hidden so that the choice of selection tiles is on a random basis. In one aspect of the game, the player must choose one selection tile for each variable or sub-class of variable, this being done with the assistance of the indicia on the face of the selection tile opposite that one which the variable or sub-class of variable is marked. The aforementioned indicia is identical for each variable of sub-class of variable. Thus by way of example, when choosing a horse color, only one color will be selected and one choice will be made from the several choices available (four choices of color being available in the embodiment illustrated, and each color variable will have a cross imprinted as indicia on the reverse side of the tile on which the name of the color is printed). Similarly, different indicia are employed for the remaining variables or subclasses of variables such as the name of the horse as illustrated by FIG. 4, the type of the horse as illustrated by FIG. 5, and the name of the jockey as illustrated in FIG. 6.

After the selection tiles are chosen, the movement tiles are selected. Any number of movement tiles may be taken in turn and any number of movement tiles may be played in turn. Thus a player may select by the rules of the game two movement tiles and play one movement tile. The play of the movement tiles is effected by placing such tile face up with the variable and numerical score showing that the player wishes to have added to the file underneath the corresponding variable rank on the game board 10. This process is repeated with each player selecting and playing in turn until all tiles are played after which the total number of points entered in the files underneath the variable ranks is summed up and these sums given to the player who randomly selected the variable by means of the selection tile.

The movement tiles preferably have all combinations of variables or sub-classes of variables on both faces. The same variables or sub-classes of variables do not appear on opposite faces of any one movement tile. A numerical value is assigned to each of the movement tiles and, in the embodiment illustrated for the horse racing game, each combination of sub-classes of variables has a numerical value of 1, 2, 3 and 4.

During the course of play, each player inserts his movement tiles in the file underneath the rank 20 which they are assigned on the playing board 10 so that the other players may estimate what variables have been randomly chosen from the selection tiles. Once a player is able to discern a pattern of a competing player favoring one variable over the others, this player will not add to the score of the competing player by playing that variable. Thus, an element of skill as well as chance is introduced into the play of the game.

In a specific embodiment, the game of the present invention comprises a horse racing game and consists of 96 movement tiles and 16 selection tiles as described above. Again, the playing board is separated into two sections, the first sections 12, 14 16 and 18 comprising the track section and is used for players to score the play of their movement tiles in accord with the numerical value on the lower right corner of the movement tile. The other section comprising the ranks 20 is used for the players to place their movement tiles after they are randomly selected. Other equipment that may be employed in the game comprises a tile box, one four-sectioned selection box and one die.

In the horse racing embodiment of the present game, the 96 movement tiles represent the names of four horses, the names of four jockeys, the colors of four horses and the types of horses, i.e., gelding, colt, mare or filly. Each tile has either the horse name, jockey, color or type on each side of that tile. There is also a number ranging from 1 to 4 on each tile. This number is of equal value on either side of any one particular tile and represents the value of that tile to be scored or the lengths which that particular variable may be scored.

To provide an equal chance of progression for each player, each of the horses' four names, four colors, four jockeys and four types appear equally on the movement tiles. The numbers on the tiles or length movement also appear in an equal distribution. Each horse's name is on twelve tiles once with each jockey, each color and each type of horse. Each jockey's name appears once with each color, each horse type and each horse name. Each horse's color appears once with each type of horse, horse's name and jockey's name. Each type of horse appears with each color, horse's name and jockey's name. It should be important to note that a horse's name will not appear on both sides of any one tile, the same applying for a horse's jockey, color or type.

Length movements or numbers one through four also appear in an equal distribution. Each horse's name has the opportunity to move either one length, two lengths, three lengths, or four lengths. Each of these opportunities appears three times apiece. The same opportunities appear each for jockey, color and type of horse. A horse's name with a length value of four will appear with one jockey, one color, and one type of horse. The same fact holds true for a length value of: three, two and one. If one horse's name appears on a tile with one horse's color, and a length value of one, that particular horse's name will still appear with a second horse's color and a length value of three, with a third color for two lengths, and with the last color for the last remaining length value of four.

The sums of the numbers for each variable or subclass of a variable will be the same. Specifically, as applied to the horse racing game of the present invention, the sum of all of the length movements or numbers for a particular horse, e.g., Waxxy, will be the same as the sum of all of the numbers or length movements for the jockeys, e.g., Cortez, and similarly for each subclass of variables in the horse racing game. In one embodiment of the horse racing game, the sum of these length movements for each sub-class of variable will be no greater than 30 where the individual numbers or length movements range from 1 to 4.

In one embodiment, to start the game, each player will roll a single die once. The highest roller goes first. The remaining players go in clockwise rotation. The first player begins by picking one selection tile from each of the four groups of selection tiles in the selection tile box. After they record their selection on a piece of paper, they replace the selection tiles in their respective sections in the selection tile box. The remaining players then repeat this process of selection. Meanwhile, all players make sure that no one else sees the selection that they have chosen randomly. These selections determine what specific horse's name, jockey, color and type of horse each player will be trying to move. More than one player may be trying to move the same horse's name, jockey, color or type of horse. Beginning with the first player, each player then picks two tiles from the movement box. Each player now has four options of movement. The first player chooses which of his four options to use. He indicates this to the other players by placing the option he has chosen face up in his file underneath his rank on the movement board 10. The other players are not to be shown what option is on the reverse side of the tile so played. The player then moves or scores the numerical value on the movement tile underneath the corresponding rank for either name of horse, color of horse, jockey or type of horse on the board 10. The number on the movement tile represents how many lengths the sub-class of variable is moved on the track. To replace the tile the player has used, they must pick another tile from the movement tile box. Each player follows this course of play until there are no more movement tiles left to pick and no more movement tiles left to play. To determine the winner, each player adds up the total number of points corresponding to the name of the horse, the type of the horse, the color of the horse and the jockey he has chosen at the beginning of the game. This total number will be obtained from any one of the columns 12, 14, 16 or 18 on the board 10. The player with the highest numerical score is the winner. In the event of a tie, the player who moved his own selections the most is the winner.

The purpose of the board 10 is to show every player what pieces are being moved by a competing player. If a player has no files which will move their selections, they should try to figure which option will help their opponents the least. However, if a player has one tile with one of their selections on each side, they should use the option which they think will only benefit themselves. Smart players can also confuse their opponents by using the same one tile when they have no selection options of their own. This could lead other players to use their opponent's selection when they have none of their selection options. The players must be careful though because if another player is using this tactic, they will move the competing player's selections in an unequal proportion to the rest of the players. It could mean the difference between winning or getting stuck at the gate (i.e., not being able to advance).

Although the invention has been described by reference to some embodiments, it is not intended that the novel game be limited thereby but that modifications thereof are intended to be included as falling within the broad scope and spirit of the foregoing disclosure, the following claims and the appended drawing.

What is claimed is:

1. A game comprising a plurality of selection tiles each selection tile having two faces, one of a group of variables appearing on only one face of said selection tile, a selection tile being provided for each of said variables, a plurality of movement tiles, each of said movement tiles having two faces, each of said faces of said movement tiles having a variable thereon in an arrangement so that the same variable does not appear on both faces of any one of said movement tiles, each movement tile having a number on both faces of said movement tile, any one of a plurality of numbers being applied to said movement tile faces, the sum of such numbers for each group of variables being the same, a playing board comprising crossed lines forming a plurality of ranks and files of spaces, said ranks being provided for and including each said variable, said files underneath said ranks being used to score said game by recording in a particular file the number appearing on the uppermost face of a movement tile upon which also appears the variable of the particular file when said movement tile is played by a person competing in said game.

2. The game of claim 1, where each said selection tile has two faces, one of a plurality of sub-classes of variables appearing on only one face of said selection tile, a selection tile being provided for each of said sub-classes of variables, the face of said selection tile not having said sub-class of a variable appearing thereon being marked by indicia for differentiating one class of selection tiles from another, each of said movement tiles having two faces, each of said faces of said movement tile having a sub-class from said variables thereon in an arrangement so that the same sub-class of said variables does not appear on both faces of any one movement tile, each of said movement tiles having a number on both of said faces of said movement tile, said number being the same for both faces of said movement tile, any one of a plurality of said numbers being applied to said movement tile faces, the sum of said numbers for each group of sub-classes of variables being the same, said ranks being provided further to correspond to each player competing in said game.

3. The game of claim 2 comprising a horse racing game where said variables are selected from at least two members of the group consisting of the names of horses, the colors of horses, the types of horses and the names of jockeys and said sub-classes of variables comprise at least two of a plurality of the names of horses, at least two of a plurality of colors of horses, at least two of a plurality of types of horses and at least two of a plurality of names of jockeys.

4. The horse race game of claim 3 where each of said movement tiles has a number from 1 to 4 on both sides thereof.

5. The horse race game of claim 3 where said variables comprise the names of horses, the color of horses, the types of horses and the names of jockeys and said sub-classes of variables comprise four names of horses, four colors of horses, four types of horse and hour names of jockeys.

6. The horse race game of claim 5 where each of said movement tiles has a number from 1 to 4 on both sides thereof.

7. The game of claim 1 comprising a horse racing game where said variables are selected from at least two members of the group consisting of the names of horses, the colors of horses, the types of horses and the names of jockeys.

8. The horse race game of claim 7 where each of said movement tiles has a number from 1 to 4 on both sides thereof, said numbers being the same for both faces of said movement tile.

9. The game according to claim 1 comprising a horse race game where said variables comprise the names of horses, the colors of horses, the types of horses and the names of jockeys.

10. The horse race game of claim 9 where each of said movement tiles has a number from 1 to 4 on both sides thereof, said number being the same for both faces of said movement tile.

* * * * *